United States Patent [19]

Craig

[11] Patent Number: 4,684,178

[45] Date of Patent: Aug. 4, 1987

[54] LOCKING SYSTEM

[75] Inventor: Clark E. Craig, Simpsonville, S.C.

[73] Assignee: LLC Corporation, Mauldin, S.C.

[21] Appl. No.: 768,157

[22] Filed: Aug. 22, 1985

[51] Int. Cl.[4] ..... E05C 7/06

[52] U.S. Cl. ..... 312/221; 312/217

[58] Field of Search ..... 312/219, 216, 221, 215, 312/217, 218, 220, 107.5

[56] References Cited

U.S. PATENT DOCUMENTS

| | | | |
|---|---|---|---|
| 3,175,872 | 3/1965 | Sullivan | 312/219 |
| 3,998,508 | 12/1976 | Scheerhorn | 312/221 |
| 4,605,266 | 8/1986 | McKernan et al. | 312/219 |

FOREIGN PATENT DOCUMENTS

| | | | |
|---|---|---|---|
| 142633 | 2/1948 | Australia | 312/219 |

*Primary Examiner*—Kenneth J. Dorner
*Assistant Examiner*—Gerald A. Anderson
*Attorney, Agent, or Firm*—Allegretti, Newitt, Witcoff & McAndrews, Ltd.

[57] ABSTRACT

An improved central locking system for a desk includes a plurality of stop members mounted on a pivot rod attached to a panel adjacent a series of drawers. One stop member is pivoted in response to a pin drive actuator which moves when driven by a cam associated with a control drawer horizontally adjacent the other drawers.

8 Claims, 22 Drawing Figures

36
39
4
29
38
5
36

36

35
4
38
5
37
36

29
37

23
25
27
46
29
36
42
36
29
46

50
64
48
49
51
25
23
29
50
64

46
48
51
25
23
29
64

50
46
48
51

LOCKING SYSTEM

BACKGROUND OF THE INVENTION

This invention relates to an improved locking system mechanism and more particularly to a system of the type wherein locking a central lock or closing a central door or drawer of a desk automatically effects locking of associated side drawers of that desk. Alternative embodiments of the mechanism are useful for filing cabinets, credenzas and other multiple drawer furniture.

A drawer locking system for a desk and/or a credenza typically employs a center lock for locking a center drawer and a linkage connecting the center drawer to side drawers for simultaneously locking the associated side drawers. In this manner, operation of a single key in the lock of the center drawer will automatically lock the remainder of the drawers for the desk. For example, an actuating rod or shaft may extend laterally from the central lock and connect with side drawer locks associated with the side drawers. Typically, the side drawer locks will comprise a depending locking bar having a series of locking pins projecting laterally therefrom for engagement with detents asscociated with the side drawers. Rotation of the key in the central drawer lock will drive the actuating rod thereby effecting operation of the locking bar to simultaneously position the locking bar pins into or out of locking position with the side drawers.

Other types of such central locking systems are available. Applicant, for example, makes a locking bar system wherein a separate key actuated locking bar is provided for each set of side drawers. Usually, however, prior art systems require the installation of rather complex linkage mechanisms connecting the central lock with the side drawer locking bar. Thus, there has been a need for a simplfied mechanism which will effect locking of side drawers by operation of a central drawer or lock. Such a system should be easily installed, have the fewest number of parts necessary and should be reliable and inexpensive.

SUMMARY OF THE INVENTION

Briefly, the present invention comprises an improved multiple drawer locking system wherein a cam drive member is attached to a side of a control member such as a central drawer. The cam drive member engages a spring biased actuator pin when the control door or central drawer is closed. The actuator pin is mounted to slide in a support panel for the drawers. That pin, in turn, when engaged, will translate and itself engage a stop member pivotally mounted on a rod attached to the support panel. The pin thus pivots the stop member into the path of a side drawer, thereby locking the side drawer in position. Other side drawers will also be simultaneously locked as a result of additional stop members attached to the rod that pivot with the rod to engage and retain the side drawers. Thus, by closing a central drawer, associated side drawers will remain in a locked position until the central drawer is opened. In this manner it is possible to lock the central drawer using a simple lock mechanism and thereby simultaneously lock the side drawers.

Thus, it is an object of the invention to provide an improved multiple drawer locking system.

It is a further object of the invention to provide an improved multiple drawer locking system utilizing a minimum number of parts.

Still a further object of the invention is to provide a drawer locking system which eliminates long and complex mechanical linkages for connecting a lock associated with a control drawer or door to a side bar locking system.

Yet another object of the invention is to provide an easily installed and economical drawer locking system for desks and the like.

These and other objects, advantages and features of the invention will be set forth in detailed description which follows.

BRIEF DESCRIPTION OF THE DRAWING

In the detailed description which follows, reference will be made to the drawing comprised of the following figures.

DESCRIPTION OF THE PREFERRED EMBODIMENT

FIGS. 1–13 illustrate a preferred embodiment of the invention as incorporated in a typical desk having a center drawer and horizontally adjacent side drawers. Referring to FIGS. 1–13, a typical desk 8 has a center drawer 10 and a first series or set of vertically arranged side drawers 14, 16 and 18. The center drawer 10 is horizontally adjacent the first set of side drawers 14, 16 and 18. In the embodiment shown, a second set of side drawers 20, 22 and 24 is stationed on the opposite side of the center drawer 10. This is a typical arrangement of drawers for a desk 8.

Figure 1:
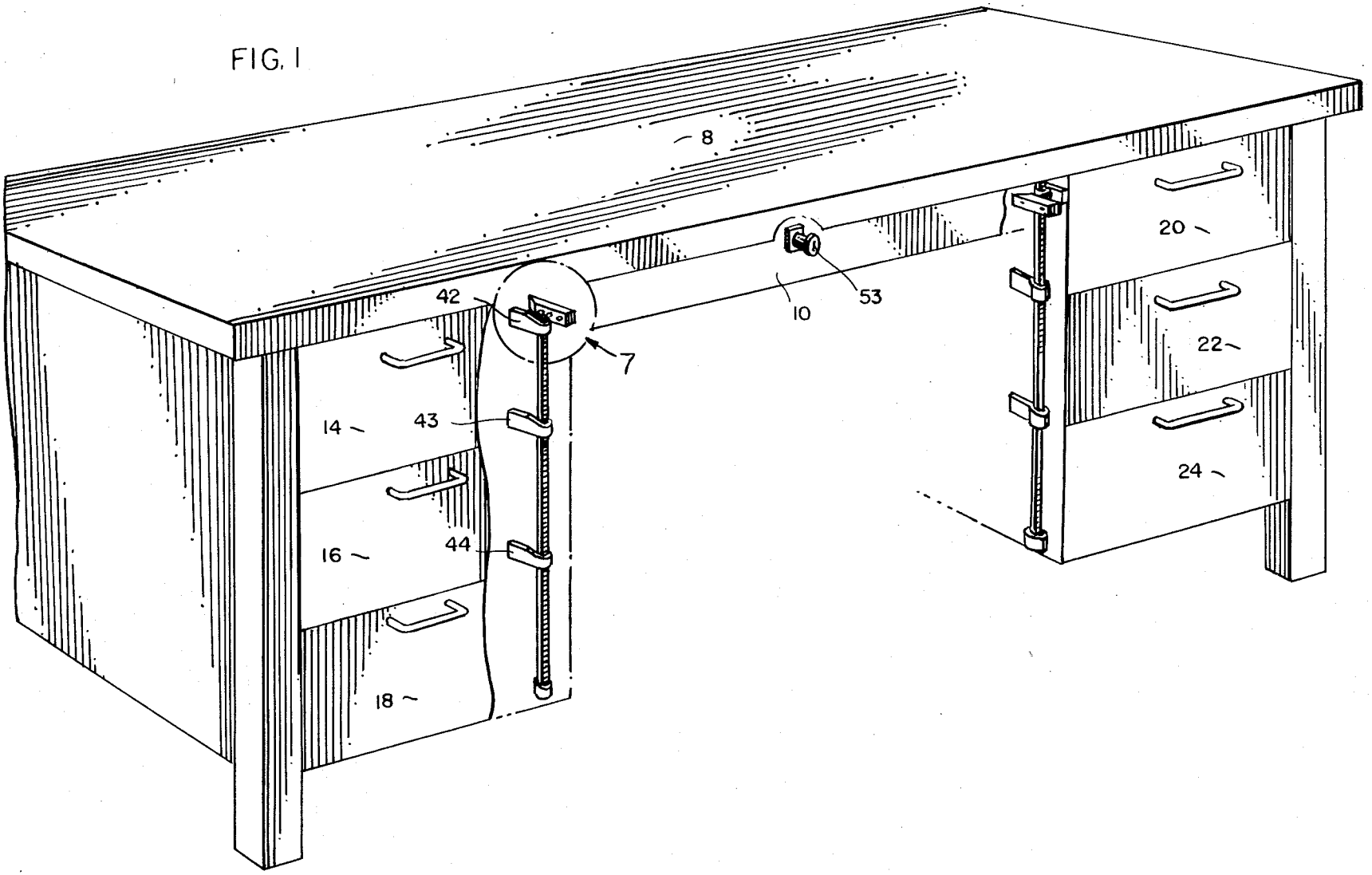
FIG. 1 is a cutaway perspective view of a desk incorporating the locking system of the invention and having a center drawer and multiple side drawers.
Figures 2, 3, 4, 5, 6, 7, 8, 9, 10:
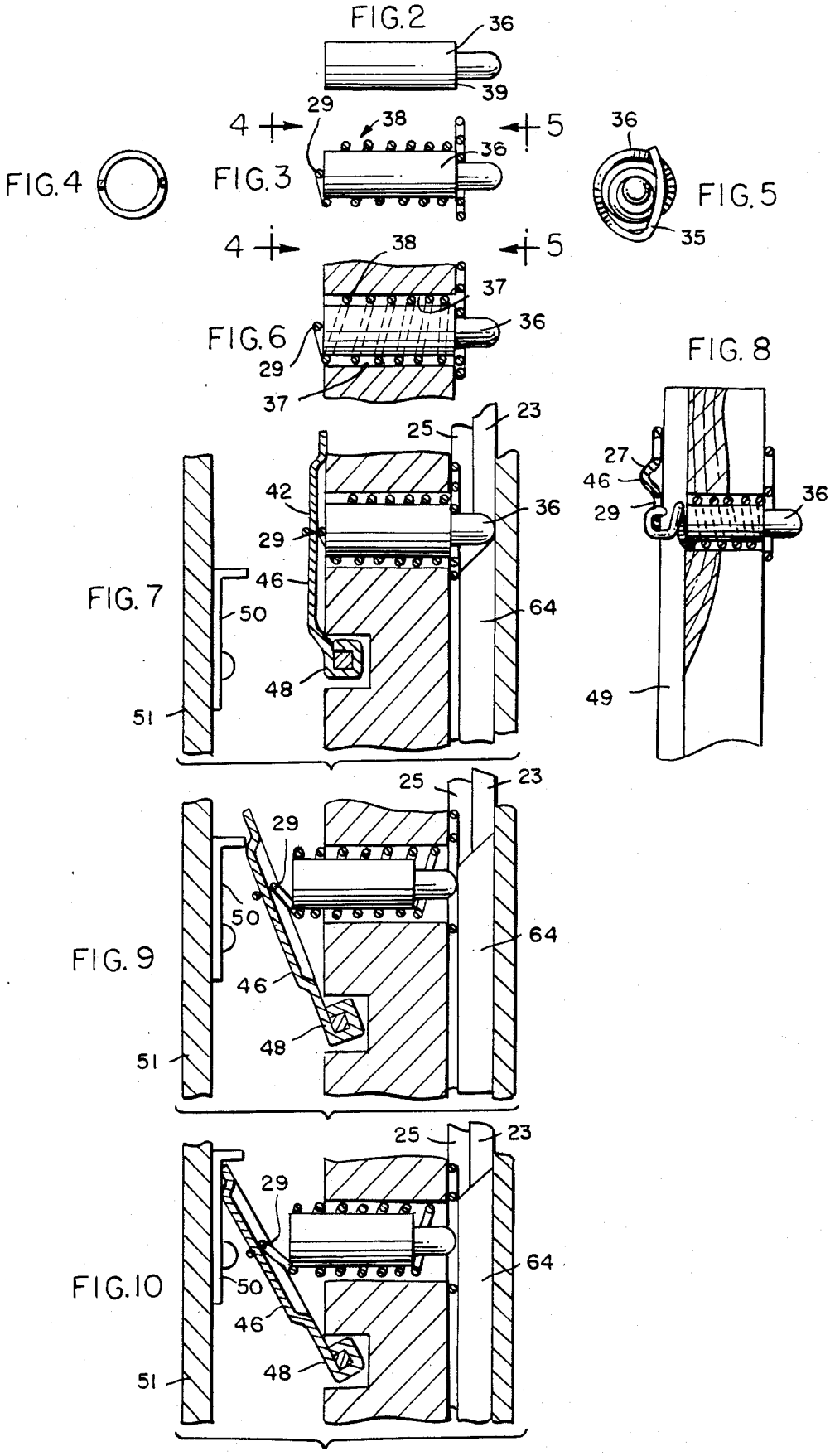
FIG. 2 is a side elevation of an actuating pin used in the locking system of the invention.
FIG. 3 is a side elevation of an actuating pin and biasing spring assembly which are incorporated as part of the locking system of the invention.
FIG. 4 is an end view of FIG. 3 along the line 4—4.
FIG. 5 is an opposite end view of the assembly of FIG. 3 along the line 5—5.
FIG. 6 is a side plan view of the assembly of FIG. 3 incorporated in a panel.
FIG. 7 is a top, cross sectional plan view of the improved locking system of the invention.
FIG. 8 is a side plan view of the assembly of FIG. 7 taken along the line 8—8.
FIG. 9 is a top, cross sectional plan view similar to FIG. 6 wherein a side drawer is partially closed.
FIG. 10 is a top plan, cross sectional view similar to FIG. 9 depicting a drawer maintained in a locked position by means of the locking system of the invention.
Figure 11:
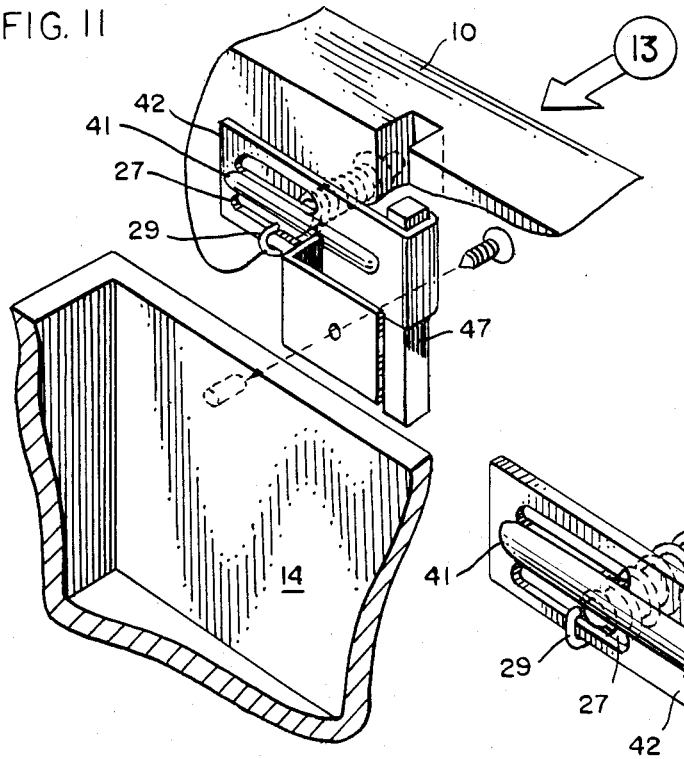
FIG. 11 is a partial perspective view of the assembly of FIGS. 8–10.
Figure 12:
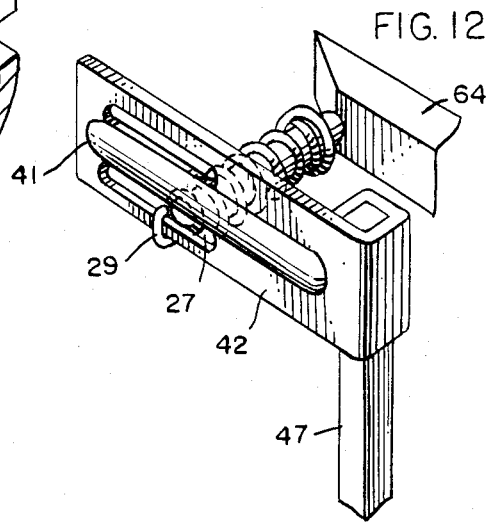
FIG. 12 is a partial perspective view of the assembly of FIG. 11.
Figure 13:
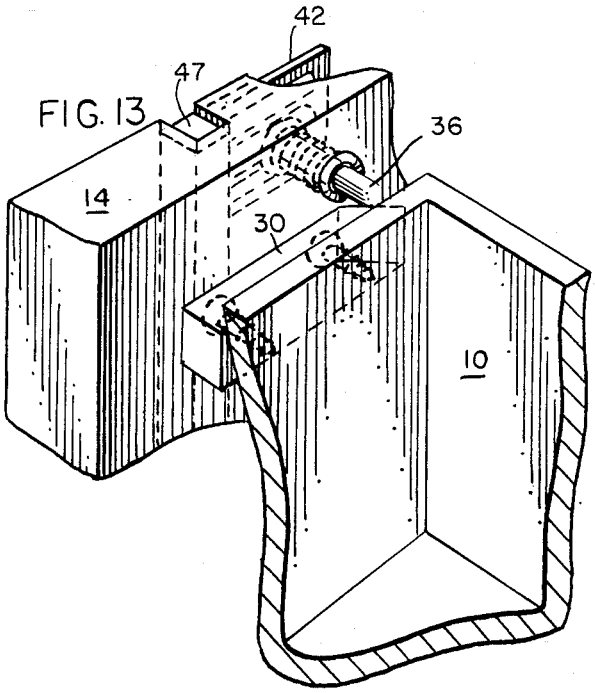
FIG. 13 is a reverse perspective view of the assembly of FIG. 11.

Each drawer, such as center drawer 10, is mounted on a drawer slide of a type known to those of ordinary skill in the art. Thus, as shown in FIGS. 8–10, a drawer slide may include a first slide and roller track 23 attached to the side 31 of the drawer 10. Track 23 is cooperative with a slide member 25 attached to a vertical support panel 26. In a similar fashion, the side drawers 14, 16, 18, 20, 22 and 24 are arranged to slide into and out of the desk 8 by means of slide hardware.

The present invention relates to a means or mechanism by which the side drawers 14, 16, 18, 20, 22 and 24 are locked in a closed position whenever the center drawer 10 is closed. Center drawer 10 thus acts as a control panel for locking or unlocking the side drawers. Referring to the figures, the center drawer 10 includes a cam drive member 30 attached to the side 31 of the center drawer 10. The drive cam 30 includes a wedge-shaped, inclined cam surface 32 connected with a planar surface 34. Cam surface 32 forms an angle of about 45° with planar surface 34.

Positioned in a passage 37 through vertical panel 26 and in opposed relationship to the drive cam 30 whenever the center drawer 10 is in the closed position is a translatable pin 36. Pin 36 is translatable in the passage 37 that extends through panel 26. Pin 36 is normally biased toward the center drawer 10 by means of a planar stop member 42 coacting with a biasing coil spring 38. Thus, coil spring 38 fits in passage 37 and surrounds the pin 36. One end 29 of the spring 38 is attached to member 42. Specifically, end 29 is defined by a loop which fits over a portion of member 42 and into a slot 27 cut into member 42. Note that member 42 includes a longitudinal rib 41 parallel to slot 27.

The opposite end 33 has oversized coils that define a diameter greater than that of passage 37 and terminates with a reduced spiral end 35 that fits against flange 39 of pin 36 to limit movement of pin 36 in coil spring 38. The pin 36 has a length which is sufficiently greater than the thickness of panel 26 so that the pin 36, when biased, will protrude into the space between the panel 26 and the side 31 of center drawer 10. Thus, when the center drawer 10 is withdrawn from the desk via slide 23, 25 or, in other words, opened, the member 42 will be biased by spring 38 to impinge on the pin 36 thereby extending the end of pin 36 into the space between panel 26 and side 31.

Stop member 42 is mounted on a pivoting rod 47 attached to the panel 26. Thus, pivot rod 47 is positioned to pivot within a longitudinal vertical slot 49 cut in the panel 26 adjacent drawers 14, 16, 18. The stop member 42 includes a forward cantilever arm 46 projecting from a hub 48. The stop member 42 is normally biased by operation of the spring 38 toward the panel 26 as illustrated in the figures. This permits the flag or stop member 42 to be flush against the panel 26 when the center drawer 10 is withdrawn. When stop member 42 is in this flush position, it is possible to withdraw the side drawer 14 from the closed to the open position.

However, if the center drawer 10 is positioned in the closed position and the side drawer 14 is likewise in the closed position, the pin 36 will be engaged by the drive cam 30. This causes the pin 36 to translate in passage 37 and engage the stop member 42 thereby pivoting the member 42 about the axis of pivot rod 47 and away from panel 26. When so pivoted, the stop member 42 engages a locking bracket 50 attached to the side 51 of the drawer 14.

As shown in the figures, one stop member 42, 43 or 44 is provided for each of drawers 14, 16 and 18, respectively. The stop members 42, 43 and 44 thus pivot simultaneously on rod 47 to engage an associated bracket; eg. bracket 50 of the adjacent, vertically stacked drawers 14, 16, 18 to thereby hold the associated drawers 14, 16, 18 in the closed position as shown in FIG. 10. In this manner all the drawers of the assembly are maintained in the closed position until the center drawer 10 is opened. The same locking arrangement is provided between the center drawer 10 and the opposite side drawers 20, 22 and 24 on the opposite side from the center drawer 10. By simple operation of the center drawer 10 between open and closed positions, it is possible to lock the entire array of drawers comprising the desk 8.

Of course, the center drawer 10 may include a cylinder lock 53 which may be used to lock the drawer 10 in the closed position. When the lock 53 is locked, it is evident that the closed, side drawers 14, 16, 18, 20, 22 and 24 are likewise in a locked position and cannot be opened until the center drawer 10 is unlocked and at least partially opened so as to disengage the drive cam 30 from pin 36.

In the event bracket 42 is extended by operation of drive cam 30 and pin 36, the drawer, eg. drawer 14 though initially open, may be closed and when closed will then be locked. FIG. 9 illustrates the closing sequence in such a situation wherein the bracket 50 rides along rib 41, thereby flexing the member 42 without engaging end 29 of spring 36. FIG. 10 illustrates the position of member 42 subsequent to flexing by bracket 50.

Figure 14:
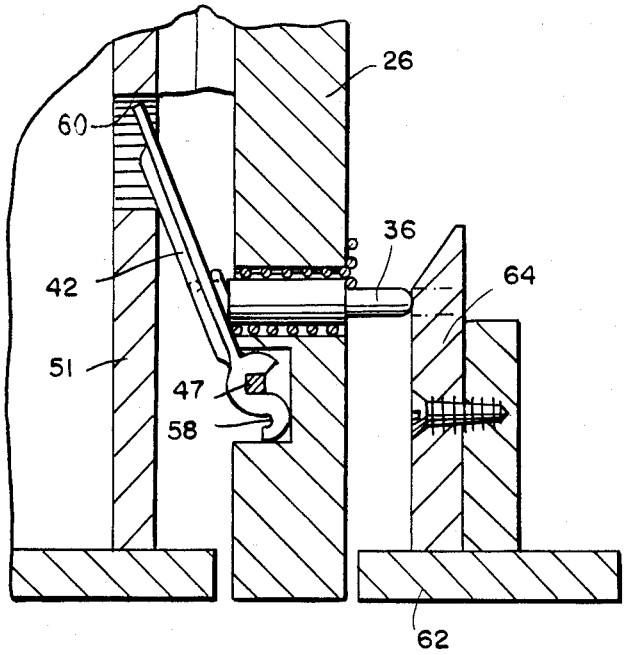
FIG. 14 is a partial cross sectional view of the locking system depicting various alternative features of the invention.

As shown in the subsequent figures, many variations of the invention are possible. For example, as shown in FIG. 14, it is possible to vary the configuration of the stop member 42. A biasing cantilever arm 58 may extend integrally from member 42 to engage the sides of slot 49 and bias the member 42 toward panel 26. Another alternative feature, also shown in FIG. 14, provides for the cantilever arm 46 to cooperate with a slot 60 in the side 51 of drawer 14 rather than with a separate bracket 50 attached to the side of the drawer. Another variation provides that the drive cam may be mounted on a door such as a credenza door 62 depicted in FIG. 14. When the door 62 is closed, a cam drive 64 mounted on the pivoting door 62 will engage the pin 36.

Various configurations of the pin 36 and associated spring 38 are also possible and it is possible to vary the shape and configuration of the drive cam 30. Additionally, it is possible to position the drive cam 30, pin 36 and stop member 42 at any cooperative position along the side of the drawers depending upon production needs or other desires. Also, it is noted that cooperative engagement of the center drawer 10 with pin 36 which, in turn, engages member 42 is all that is necessary to simultaneously operate a series of vertically spaced stop members on rod 40.

Figure 15:
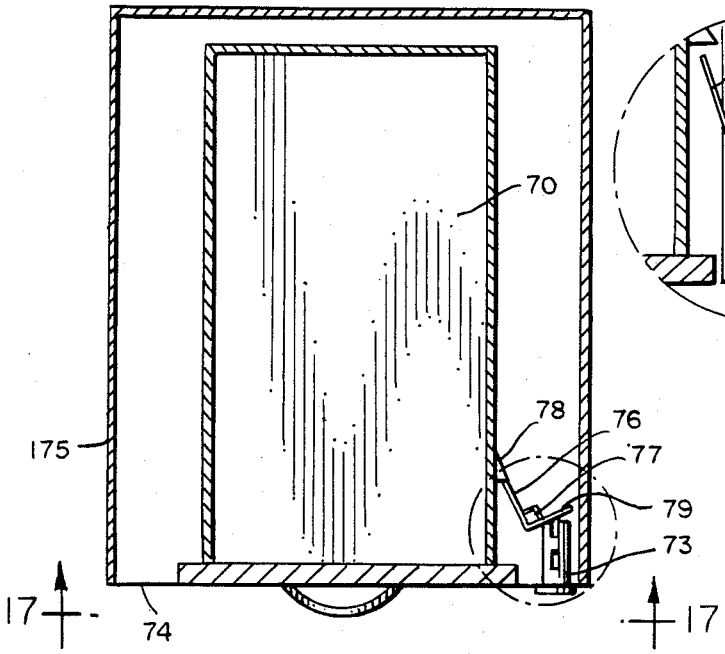
FIG. 15 is a top, cross sectional plan view of the locking system of the invention as incorporated in a filing cabinet.
Figure 16:
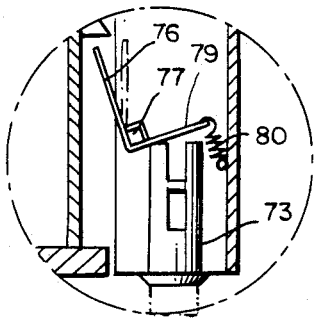
FIG. 16 is an enlarged view of the locking mechanism for the system of FIG. 15.
Figure 17:
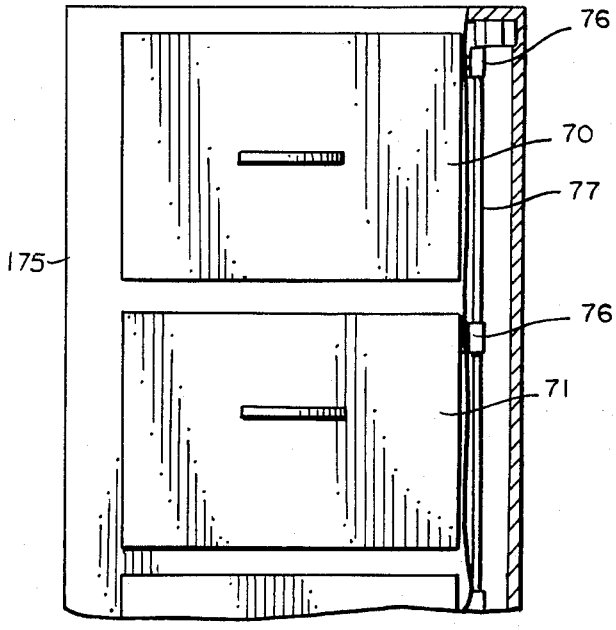
FIG. 17 is a front plan, partially cutaway view of the system of FIG. 15.
Figure 18:
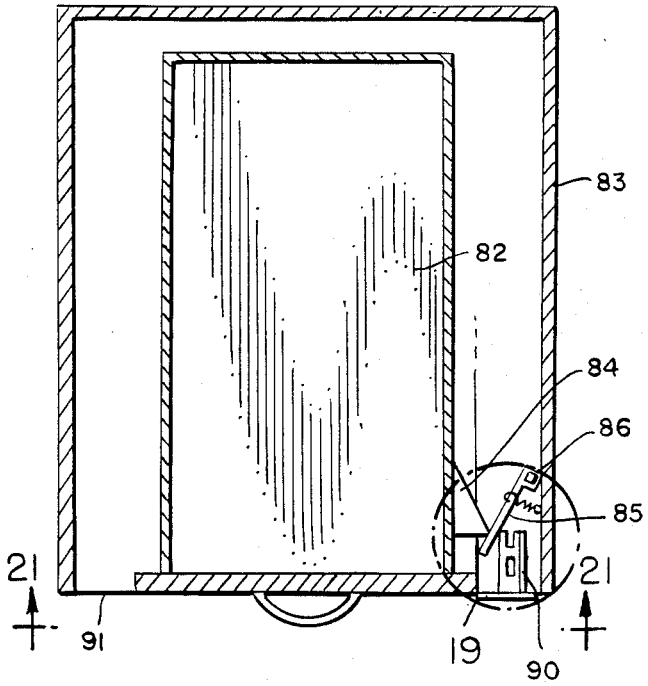
FIG. 18 is a top plan cross sectional view of another alternative embodiment of the invention incorporated in a filing cabinet.
Figure 19:
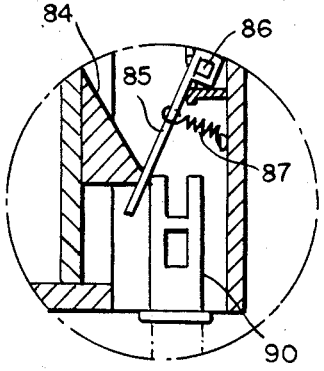
FIG. 19 is an enlarged view of the mechanism depicted in FIG. 18.
Figure 21:
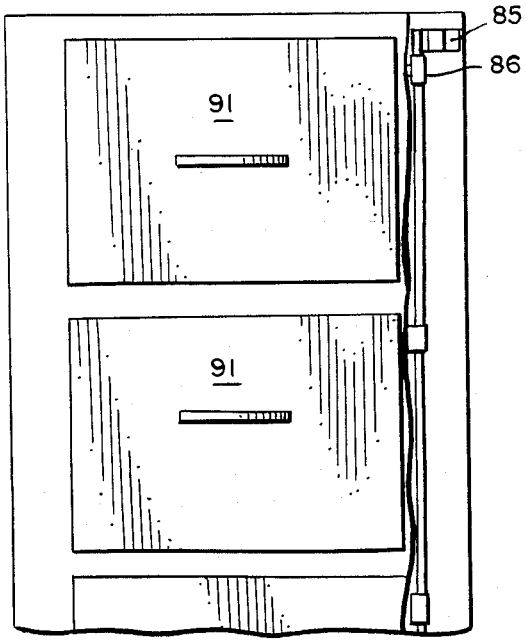
FIG. 21 is a partially cutaway, front plan view of the system of FIG. 18.
Figure 20:
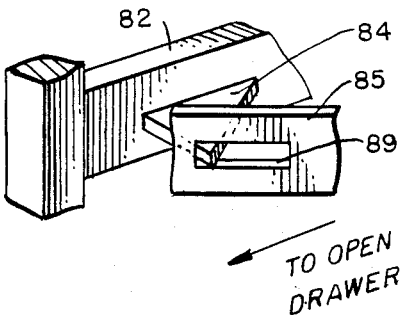
FIG. 20 is a reverse schematic view of the locking mechanism depicted in FIG. 19.
Figure 22:
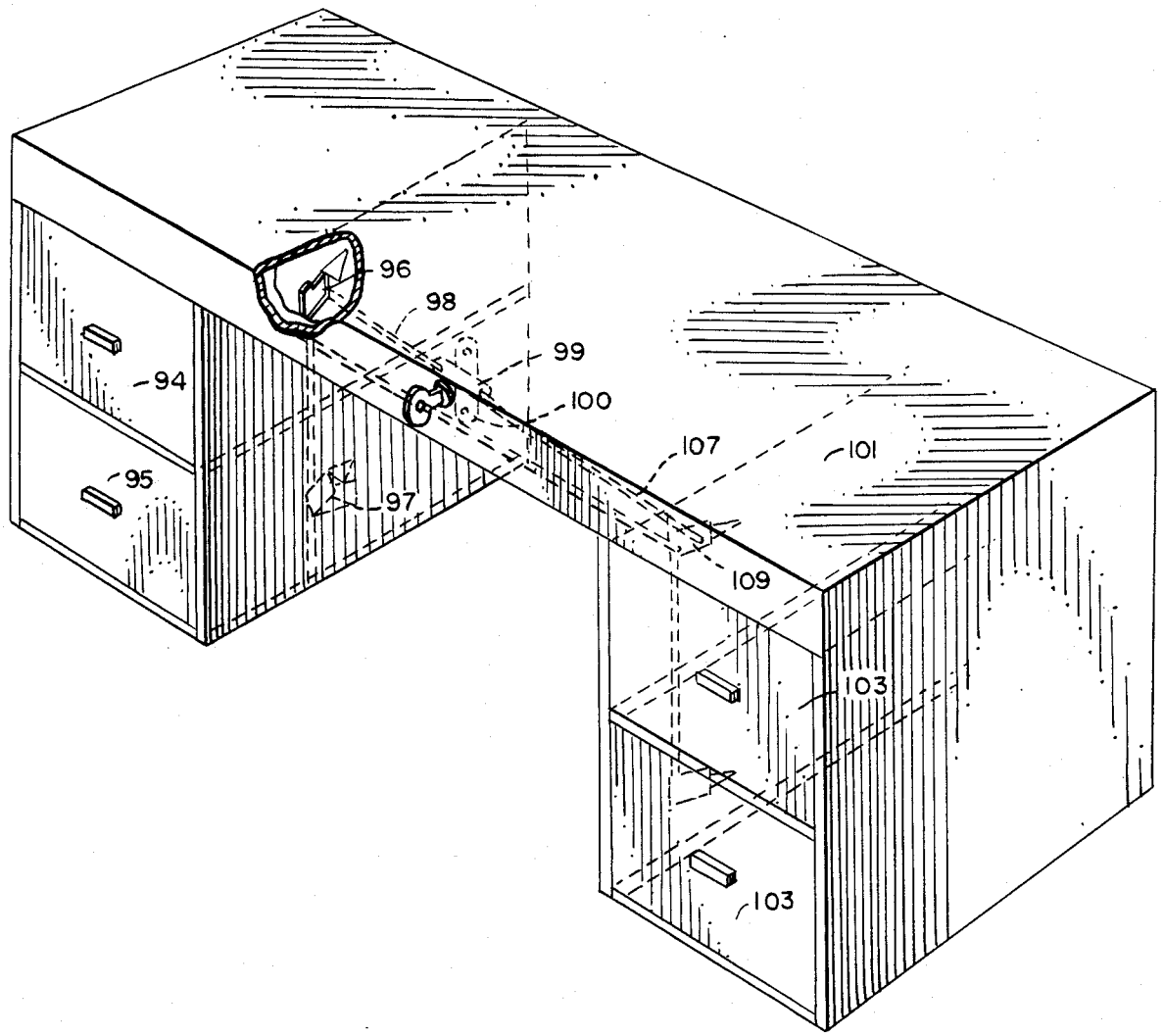
FIG. 22 is a cutaway perspective view illustrating an embodiment of the invention as incorporated into a desk without a center drawer.
Figure 23:
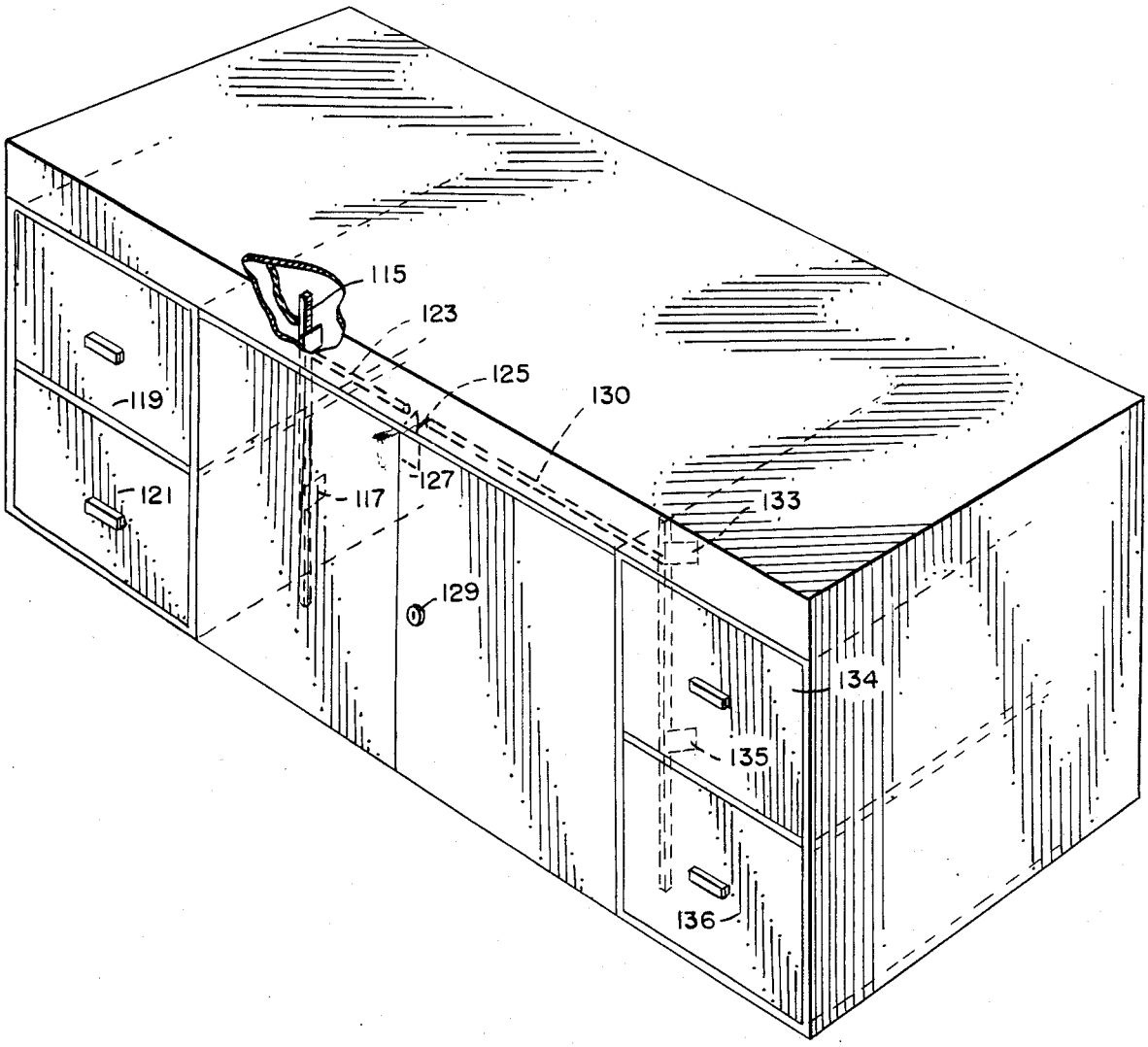
FIG. 23 is a cutaway perspective view illustrating an embodiment of the invention incorporated in a credenza of the type having center door panels mounted on hinges.

FIGS. 15 through 23 illustrate examples of further alternative embodiments of the invention. FIGS. 15, 16 and 17 illustrate an embodiment wherein the invention is incorporated in a file cabinet; FIGS. 18 through 21 illustrate another alternative embodiment of the invention incorporated in a file cabinet; FIG. 22 illustrates an embodiment incorporated in a desk that does not include a center drawer; and FIG. 23 is directed to an embodiment utilizing center positioned credenza doors and adjacent, outside positioned vertical drawers.

Referring first to FIGS. 15 through 17, a file cabinet includes a sliding drawer or series of sliding drawers 70, 71, for example, which are supported on sliding hardware as known to those skilled in the art. A pop-out cylinder lock 73 is mounted in a front panel 74 of the filing cabinet 75. The cylinder lock 73 is of the type wherein the cylinder translates inwardly and outwardly from the mounting panel 74 between an inward, locked and outward, unlocked position as depicted by FIG. 16. In the embodiment shown, the stop member 76 is mounted pivotally on a vertically, supported, pivot shaft 77 and cooperates with an extending bracket 78 attached to the side of the drawer 70. The stop member 76 includes an arm 79 which is attached to a spring 80 affixed to the side of the cabinet 75 so as to bias the stop member 76 normally away from engagement with the bracket 78. When, however, the cabinet drawers are to be locked, the key operated cylinder lock 73 will be positioned inwardly in the panel 74 to engage the arm 79 thereby pivoting the stop member 76 into engagement with the locking bracket 78. Unlocking of the cylinder lock 73 will permit the lock to disengage from the arm 79 thereby permitting the bracket stop member 76 to release the drawers.

In FIGS. 18–21, the same general construction is depicted. Thus, a drawer 82 of a file cabinet 83 includes a bracket 84 attached to the side of the drawer 82. The bracket 84 cooperates with a pivotal stop member 85 mounted on a rod 86. A biasing or spring member 87 normally retains the stop member 85 out of engagement with the bracket 84. The stop member 86 includes a center slot 89 for receipt of the bracket 84 when the bracket stop member 85 is pivoted into position. The stop member 85 pivots in response to movement of pop out, cylinder lock 90 mounted in front panel 91 of the file cabinet 83. The lock 90 in FIG. 18 thus operates in the same manner as the lock 73 in FIG. 15.

FIG. 22 depicts a system wherein there is no center drawer associated with a desk. Thus, side drawers 94 and 95 have associated therewith stop members 96 and 97, respectively, that are of the same construction as previously described. Rather than an actuator pin which extends through the mounting panels for the drawers 94 and 95, a shaft or rod 98 is mounted on a bell crank 99 associated with a rotatable cylinder lock 100 mounted in the desk 101. Lock 100 thus serves to actuate the stop member 96 and lock or unlock the drawers 94 and 95. Similarly, drawers 103 and 105 on the opposite side of the desk are actuated by means of an actuator shaft 107 which displaces the operating stop members 109 and 111.

FIG. 23 depicts yet another alternative embodiment wherein the stop members 115 and 117 associated with drawers 119 and 121 are actuated by means of elongated pins 123 that translate or move in response to a wedge member or cam drive member 125 attached to a door panel 127 defining a credenza door. The credenza door itself is locked by means of a lock 129. The pin 123 for operating the stop members 115 and 117 finds its counterpart in pin or rod 130 which actuated stop members 133 and 135 associated with drawers 134 and 136.

Thus, while there has been set forth a series of preferred embodiments of the invention, it is to be understood that the invention is to be limited only by the following claims and their equivalents.

What is claimed is:

1. An improved locking system for locking a vertical array of closed drawers of a piece of furniture simultaneously upon closing an adjacent, horizontally arrayed drawer, said horizontally arrayed drawer and said vertical array of drawers separated only by means for mounting said drawers, said system comprising, in combination:

a translatable actuator pin mounted generally transverse to the direction of drawer movement in said means for mounting;

biasing means for the pin to bias the pin away from the vertical array of drawers and toward the adjacent horizontal drawer;

a pivoting member pivotally attached to the means for mounting;

pivot mounted stop members fixed to the pivoting member, in opposed relation to the vertical array of drawers, each of said stop members extending from the pivoting member generally in the direction of drawer travel as the drawers are closed, said pivoting member having a pivot axis generally transverse to the direction of drawer travel, said pivot axis also generally transverse to the direction of translation of the actuator pin; and pin drive means for driving the actuator pin, said pin drive means attached to the adjacent horizontal drawer and movable with movement of the adjacent horizontal drawer between a position of engagement with the pin when the horizontal drawer is closed to thereby translate the pin against one stop member and thereby pivot all of the stop members outwardly from the means for mounting to engage and hold the vertical array of drawers in the closed or locked position, and a position of disengagement of the pin drive means with the actuator pin when the horizontal drawer is open, said biasing means also being connected to one stop member for biasing all of the stop members to said open or unlocked position when the horizontal drawer is open and the actuator pin is disengaged by the pin drive means.

2. The system of claim 1 wherein, at least one stop member is positioned for cooperation with each drawer in the vertical array of drawers.

3. The system of claim 1 wherein the stop members are cantilever arms extending from the pivot rod.

4. The system of claim 1 wherein a drawer in the vertical array of drawers includes a drawer bracket projecting generally transversely from the side of said drawer toward the means for mounting said drawer, whereby a stop member engages the drawer bracket to hold the said drawer in position when one of the stop members is actuated by the pin.

5. The system of claim 1 wherein the horizontal drawer includes a cam drive attached to the side of the drawer, and including means for locking the horizontal drawer in a closed position thereby simultaneously locking all the closed drawers in a closed position.

6. The system of claim 1 including a second cantilever arm extending from the pivot rod and engaging the means for mounting, said second cantilever arm comprising the biasing means.

7. The system of claim 1 including a coil spring defining a passage in the means for mounting, one end of said spring attached to the stop member and the other end of said spring attached to the means for mounting, said stop member engaging the pin to thereby bias the pin.

8. An improved multiple drawer locking system for a cabinet having at least two vertically arranged slidable drawers, comprising, in combination:

a cabinet wall along one side of the drawers, a vertical pivot rod pivotally mounted on the wall and defining a pivot axis, a series of cantilever arm stop members affixed to the rod and pivotal between a first locking position and a second unlocking position in response to pivotal movement of the rod;

biasing means for biasing the stop members to the unlocking position;

means for engaging at least one stop member and driving the stop member and the rod pivotally from the first unlocking position to the second locking position to thereby simultaneously drive the other stop members attached to the rod, said means including a translatable actuator pin through the cabinet wall engageable with a designated stop member, a horizontally arrayed drawer, and cam drive means attached to the drawer for engaging the pin when the drawer is closed to drive the pin against the designated stop member and pivot the stop members to the locking position; and means on each drawer for cooperation with an associated stop member to limit drawer movement when the stop member is in the locking position.

* * * * *